US005442329A

United States Patent [19]

Ghosh et al.

[11] Patent Number: 5,442,329

[45] Date of Patent: Aug. 15, 1995

[54] WAVEGUIDE ROTARY JOINT AND MODE TRANSDUCER STRUCTURE THEREFOR

[75] Inventors: Subir Ghosh; Luiz C. Da Silva, both of Kitchener, Canada

[73] Assignee: SG Microwaves Inc., Kitchener, Canada

[21] Appl. No.: 161,258

[22] Filed: Dec. 9, 1993

[30] Foreign Application Priority Data

Dec. 4, 1992 [GB] United Kingdom ..... 9225367

[51] Int. Cl.[6] ..... H01P 1/06; H01P 1/16

[52] U.S. Cl. ..... 333/21 R; 333/257; 333/261

[58] Field of Search ..... 333/256, 257, 261, 1, 333/21 R; 343/763

[56] References Cited

U.S. PATENT DOCUMENTS

| | | | |
|---|---|---|---|
| 2,584,399 | 2/1952 | Preston | 333/257 |
| 2,736,867 | 2/1956 | Montgomery | 333/256 X |
| 3,127,579 | 3/1964 | Smith | 333/256 |
| 3,715,688 | 2/1973 | Woodward | 333/256 X |

FOREIGN PATENT DOCUMENTS

| | | | |
|---|---|---|---|
| 597240 | 1/1948 | United Kingdom | 333/256 |
| 2218854 | 11/1989 | United Kingdom | 333/261 |

*Primary Examiner*—Benny T. Lee
*Attorney, Agent, or Firm*—Anthony Asquith & Co.

[57] ABSTRACT

The rotor of the joint includes two rectangular waveguide ports, carrying two separate signals. The stator has two corresponding rectangular waveguide ports. The ports are coupled with a circular waveguide, which comprises two relatively rotatable stub-cylinders, disposed co-axially in-line on the axis of rotation. Signal A is transmitted through the circular waveguide, across the joint, in the TM01 propagation mode, while signal B is transmitted across the joint in the TE01 mode. These circular-symmetrical modes, with mutually orthogonal field distribution, are able to cut cross-talk interference, since the mode transducers of these modes maintain good mutual isolation, even though the signals are present together in the circular waveguide, and at the same or similar frequency. The TM01 mode (signal A) is excited, and received, by means of slots formed in the end wall of the circular waveguide stubs. The port for signal A communicates with the circular waveguide through the two slots. The TE01 mode (signal B) is excited, and received, by means of four axial slots formed in the cylindrical wall of the circular waveguide. The transducer for signal B is disposed in a wrap-around relationship with the circular waveguide, and is in communication with the circular waveguide through the four slots. An E-plane junctional continuation communicates the port for signal B, via two slots, with the transducer for signal B.

17 Claims, 4 Drawing Sheets

WAVEGUIDE ROTARY JOINT AND MODE TRANSDUCER STRUCTURE THEREFOR

This invention relates to rotating joints for microwave waveguides. Such joints are used for example in mechanically scanned radars, satellite antennas, and the like, which require propagation of microwave signals through the rotating joint.

BACKGROUND TO THE INVENTION

Often, in a system with such a rotating joint, it is the case that two separate waveguide propagation lines carry two separate microwave signals, and it is a requirement that the two separate microwave signals be passed through the rotary joint, simultaneously. It is desirable under such a requirement that the rotary joint would: first, accept the two microwave signals at two separate waveguide inlet ports; second, propagate the two signals simultaneously in a common waveguide through the rotary joint; and third, deliver the two signals at two separate waveguide outlet ports.

In some cases, the two microwave signals may pass through the rotary joint in opposite directions; for example, transmit and receive signals. In other cases, the two signals may pass both in the same direction through the rotary joint. In both cases, it is important that there should be substantially no spurious propagation modes generated by the passage of either of the two signals, at or by the joint, of such a nature as could lead to undue attenuation of either signal, or as could interfere with, or be detected as a component of, the other signal.

BRIEF REVIEW OF THE INVENTION

It is recognised that in order to be propagated through a rotating joint the mode of the microwave energy passing through the joint should be circular-symmetrical. In the invention, two signals A and B are propagated through the joint with respective separately distinct circular-symmetrical propagation modes. The two modes utilised in the invention, for the two signals, are the TE01 mode and the TM01 mode. That is to say, signal A is propagated as a TM01 mode, and signal B is propagated as a TE01 mode.

The invention provides a waveguide rotary joint, which comprises a stator, a bearing, and a rotor which is supported in the bearing and is guided thereby for rotation about an axis of rotation with respect to the stator.

The rotor and the stator include respective stub-waveguides, which are each of the same circular cross-sectional form, and which are disposed co-axially in-line on the said axis of rotation.

Having in mind the frequencies of the signals A and B, the designer sets the dimensions of the circular waveguide whereby the circular waveguide is effective to propagate microwave energy of at least one of the two signals in the TE01 mode, and of the other signal, or of both of the two signals, in the TM01 mode.

The invention may be used when the signals are of the same frequency, or when one signal is as much as about double the frequency of the other.

In the invention, the rotary joint includes an interface means which is so constructed and arranged as to permit energy propagation at that frequency in both the TE01 and the TM01 modes between the two stub-waveguides, substantially without the excitation of other propagation modes at the joint.

Preferably, the interface means comprises recesses formed in the walls of the circular waveguide at the interface, so arranged as to constitute a choke.

In a preferred form of the rotary joint, the rotor includes two rotor waveguide ports A and B, each of rectangular cross-section, and the stator includes two stator waveguide ports A and B, each of rectangular cross-section. A TM01-mode transducer comprises a means for transducing microwave energy in the rotor port A into energy in the TM01 mode in the circular waveguide, and a TE01-mode transducer comprises a means for transducing microwave energy in the rotor port B into energy in the TE01 mode in the circular waveguide.

Preferably, the circular stub-waveguide of the rotor is formed with an end wall; the waveguide port A of the rotor includes an H-plane Tee-junction box chamber which is disposed outside the end wall; and the TM01 excitation means comprises slots formed in the end wall, the slots communicating the circular waveguide with the box chamber. Preferably, the slots in the end wall are two in number.

Preferably, the rectangular waveguide port B of the rotor is in energy-propagating communication with an annular chamber, which is disposed in a wrap-around relationship with respect to the circular stub waveguide; and the TE01 excitation means includes axially-aligned slots formed in the cylindrical wall of the stub-waveguide. Preferably, the axially aligned slots are four in number. Preferably also, the rectangular waveguide port B includes a portion thereof which is disposed in wrap-around relationship with the annular chamber, and the TE01 excitation means includes two slots communicating the portion with the annular chamber.

It is recognised that the two modes can be accommodated together in the circular waveguide. It is further recognised that the two modes can be excited by means of structures that can also be provided together in the rotary joint. In the preferred structure, with the combined exciters, the circular stub-waveguide of the rotor is formed with an end wall; the waveguide port A of the rotor includes a box chamber which is disposed outside the end wall; the TM01-mode transducer comprises two slots formed in the end wall, the slots communicating the circular waveguide with the box chamber; the rectangular waveguide port B of the rotor is in energy-propagating communication with an annular chamber, which is disposed in a wrap-around relationship with respect to the circular stub waveguide; and the TE01-mode transducer comprises four axially-aligned slots formed in the cylindrical wall of the stub-waveguide.

BRIEF DESCRIPTION OF THE DRAWINGS

By way of further explanation of the invention, exemplary embodiments of the invention will now be described with reference to the accompanying drawings, in which.

Figure 1:
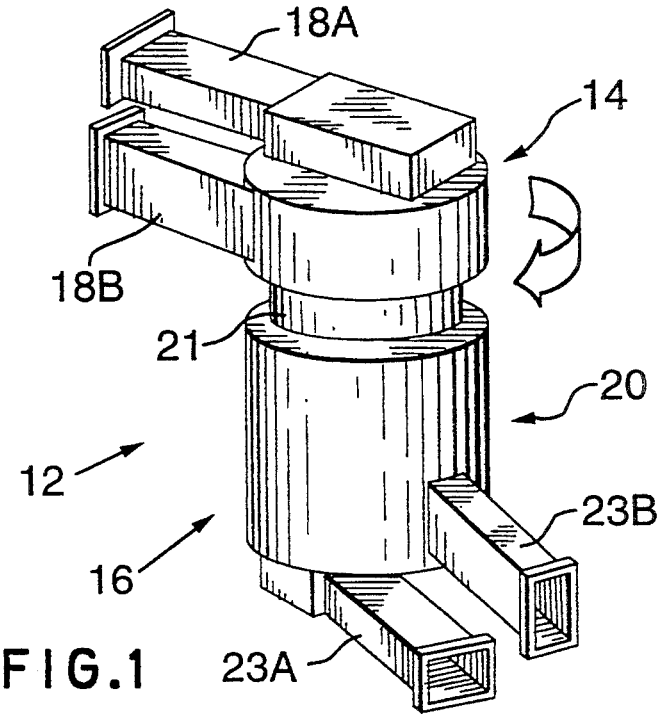
FIG. 1 is a pictorial view of a rotary joint which embodies the invention.

The devices shown in the accompanying drawings and described below are examples which embody the invention. It should be noted that the scope of the invention is defined by the accompanying claims, and not necessarily by specific features of exemplary embodiments.

DETAILED DESCRIPTION OF PREFERRED EMBODIMENTS

FIGS. 1, 3, 4A, 4B, and 5 show details of the structure of a rotary joint 12, comprising a rotor 14 and a stator 16. The joint is intended for continuous rotation of the rotor; i.e. the rotor does not have to reverse cyclically. Integral with the rotor 14 are two rectangular waveguide ports 18A, 18B. The rectangular ports 18A, 18B connect to a circular waveguide 20, which, in the rotor 14, has the form of a cylindrical stub 21.

Figure 5:
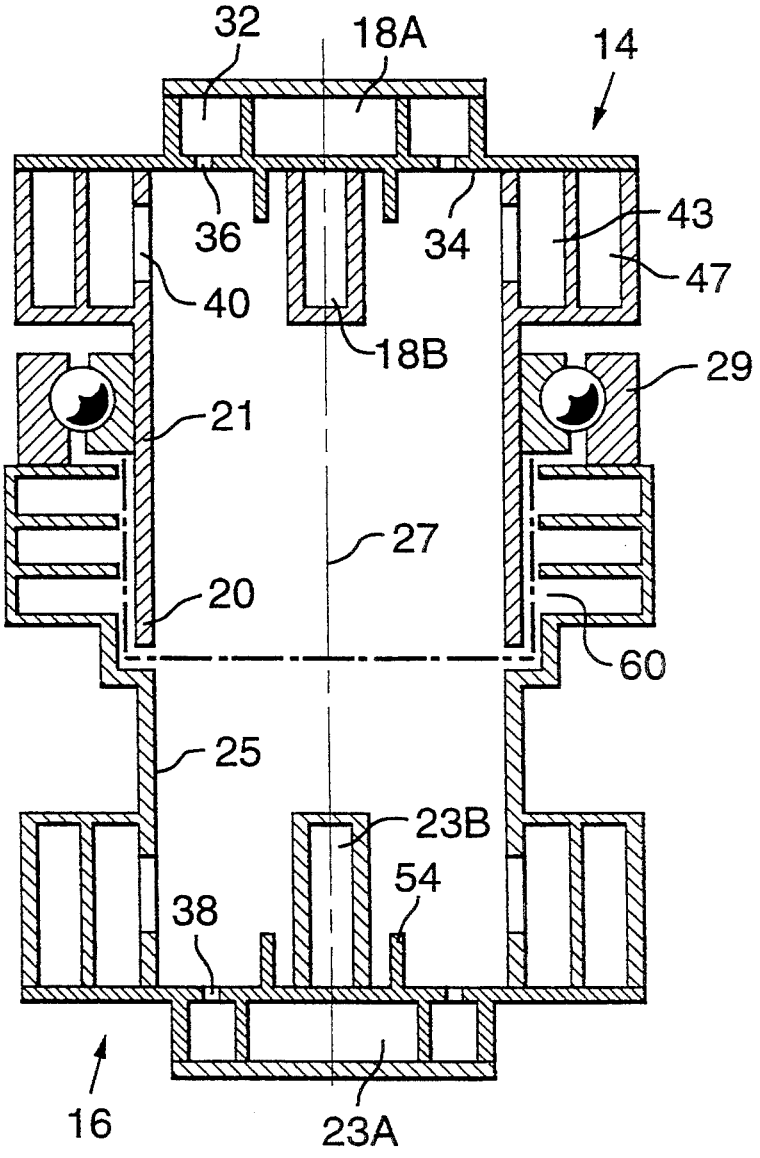
FIG. 5 is a cross-section of the joint structure of FIG. 1, which shows the transducers together.

Integral with the stator 16 are two more rectangular waveguide ports 23A, 23B. These ports connect to the circular waveguide 20, which, in the stator 16, has the form of a cylindrical stub 25 (as seen in FIG. 5). The cylindrical axis 27 of the stator 16 is co-axial with that of the rotor 14. Bearings 29 constrain the rotor 14 for rotation about the said axis 27.

It is the aim of the rotary joint structure as described that microwave energy may be propagated across the joint 12, between waveguide ports 18A and 23A without effect upon ports 18B and 23B, and between ports 18B and 23B without effect upon ports 18A and 23A, and that such propagation can take place while the joint is rotating.

In order to pass microwave energy across the rotary joint 12, the mode thereof, within the circular waveguide 20 (i.e. the, circular waveguide as defined by the two cylindrical stubs 21,25) should be one of the circular-symmetrical modes. The joint 12 contains a transducer means for exciting one such mode in the circular waveguide 20 for the signal-path defined by waveguide ports 18A and 23A (signal A), and another transducer means for exciting another circular-symmetrical mode in the circular waveguide 20 for the signal path defined by ports 18B and 23B (signal B).

The joint 12 also includes complementary transducer means for receiving the energy in these circular-symmetrical modes. In fact, the exciting transducer, in the rotor, for signal A is of the same form as the receiving transducer, in the stator, of signal A, and the exciting transducer, in the rotor, for signal B is of the same form as the receiving transducer, in the stator, of signal B, whereby both pairs of transducers can propagate energy in the respective modes in either direction through the joint.

Figures 2A, 2B:
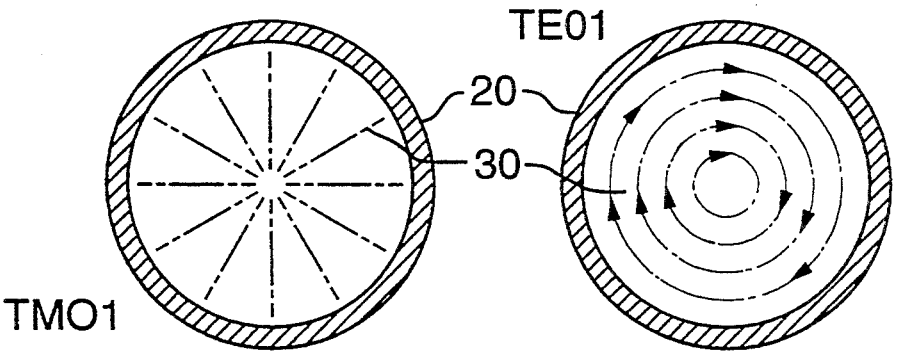
FIGS. 2A and 2B are diagrams illustrating electric field lines of desired modes of microwave energy propagation in the circular waveguide of the rotary joint of FIG. 1.

FIGS. 2A and 2B are diagrams illustrating the TM01 mode (FIG. 2A) and the TE01 mode (FIG. 2B) in the circular waveguide 20. In these diagrams, the lines 30 represent the lines of force of the electrical field. In keeping with conventional nomenclature for waveguide energy modes, the T stands for transverse, and the E or M stands for electrical or magnetic, respectively. The numbers refer to the disposition of the waves in the plane at right angles to the length of the waveguide: the first number is the number of wave-nodes occupying the circumference of the waveguide; and the second number is the number of wave-nodes occupying a diameter of the waveguide. Both these two modes can be excited independently, but simultaneously, in a circular waveguide. It is recognised that suitable transducers can be arranged to excite the two modes separately and independently, as the respective carrier modes for the two signals A and B, and that all other modes can be substantially suppressed; it is this fact that makes these two modes so suitable for the situation where two modes are to be propagated simultaneously without cross-interference.

Figure 3:
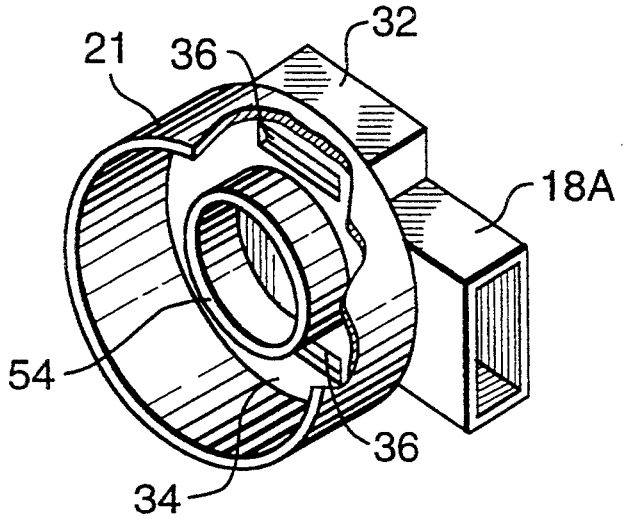
FIG. 3 is a pictorial view illustrating a first transducer of the joint of FIG. 1.

The exciting transducer for signal A is illustrated in FIG. 3. Energy in the waveguide port 18A typically has a TE01 (rectangular) mode appropriate to the rectangular waveguide form, which is to be transduced into the TM01 mode in the circular waveguide 20. The port 18A terminates in an H-plane T-junction box chamber 32, which defines an end wall 34 of the hollow interior of the waveguide 20. In the end wall 34 are provided two slots 36, lying diametrically opposite each other.

The dimensions of the waveguide; 20 are determined in anticipation of the frequency or wavelength of the microwave signal A. The (internal) diameter of the waveguide is greater than one-half wavelength of the signal A. The slots 36 lie on a circle of approx one-half wavelengths diameter.

Each slot 36 extends over an arcuate length of approx one-half wavelength. The slots may be straight (as shown in FIG. 3) or arcuate. To avoid spurious propagation modes being set up, the slots 36 should be accurately identical, and should be accurately located symmetrically with respect to the waveguide.

Disposed as described, the slots 36 are instrumental in exciting the microwave signal in the rectangular port 18A into the circular waveguide 20, in the TM01 mode. Similar slots 38 (FIG. 5) are located in a similar end wall in the stator 16 of the joint, whereby a TM01-mode signal present in the circular stator waveguide stub 25 is received through the slots 38, and the signal is transduced into a mode in which the signal passes along the port 23A.

Other structures are contemplated by means of which the signals in the ports 18A and 23A can be transduced into, and from, the TM01 mode, as will be described presently.

Figure 4A:
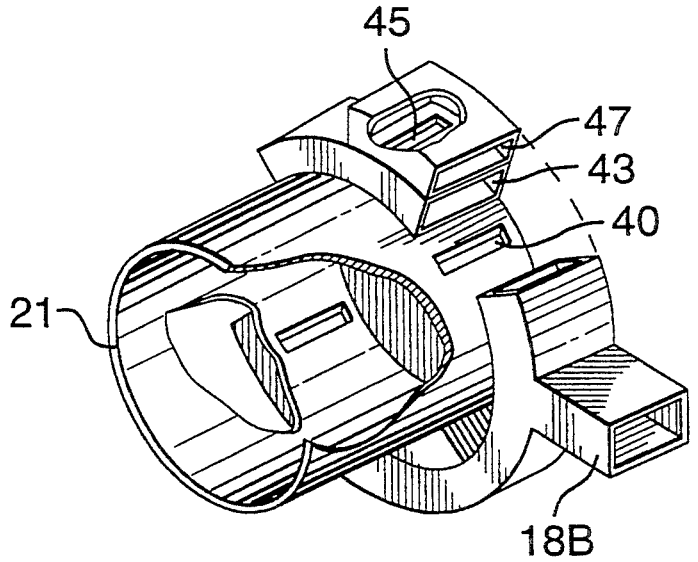
FIG. 4A is a pictorial view illustrating a second transducer of the joint of FIG. 1.
Figure 4B:
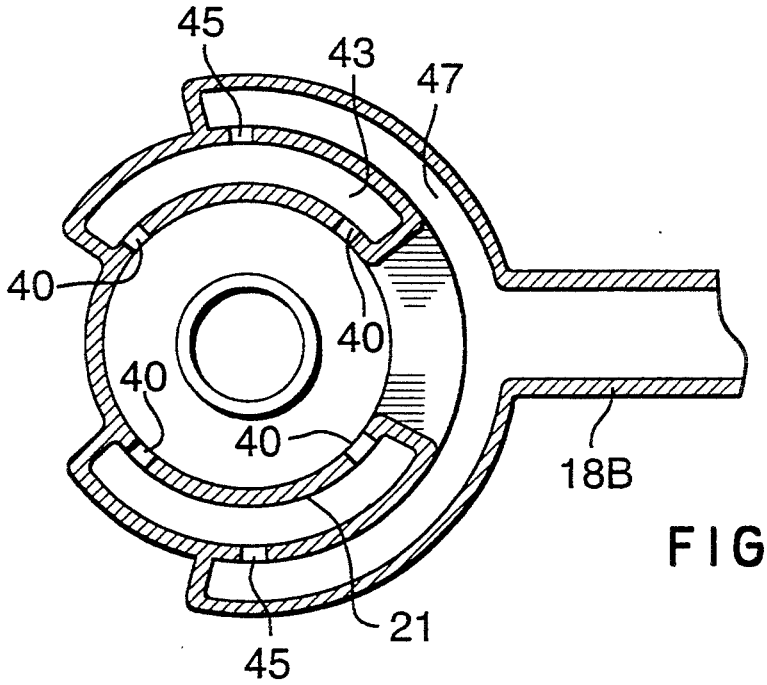
FIG. 4B is a cross-section of the transducer of FIG. 4A.

The TE01 mode is excited in the circular waveguide 20 by means of the exciting transducer for signal B, which is shown in FIGS. 4A and 4B.

For propagating the TE01 mode, the circular waveguide 20 should be greater than one wavelength of the signal B in diameter.

The cylindrical wall of the waveguide 20 is formed with four axially-disposed slots 40. The slots 40 have an axial length of approximately one-half wavelengths of signal B.

The four slots 40 in the wall of the waveguide are surrounded by annular chambers 43. The two chambers 43 basically comprise a nominally rectangular waveguide which is wrapped circumferentially around the circular waveguide 20. The chambers 43 are provided with two slots 45, which open into an outer chamber 47. The outer chamber 47 is an E-plane junctional continuation of the rectangular waveguide port 18B. The two slots 45 serve to couple the waveguide port 18B to the four slots 40, whereby the TE01 mode can exist in the circular waveguide 20, in correspondence with the signals in the port 18B, ever a band of frequencies.

FIG. 5 shows how the signal A exciter/receiver and the signal B exciter/receiver are provided together in the stubs 21,25 of the circular waveguide 20. As shown in FIG. 5, the structure at the end of the stator waveguide stub 25 is complementary to the structure at the end of the rotor waveguide stub 21.

As regards the presence of the two signals A and B together in the circular waveguide, the following points may-be noted. If the signals A and B are far apart in frequency (i.e. if signal B is of the order of twice the frequency of signal A), the designer is able to so arrange the dimensions of the circular waveguide that the TE01 mode of signal B and the TM01 mode of signal A are launched by the respective transducers, in the circular waveguide, each as a carrier mode for that signal, and all other modes of both signals are suppressed. The higher frequency signal would be passed through propagation line B, and the lower through line A.

On the other hand, in the case where the frequencies of the two signals are the same or close together, then, at the TE01-mode transducer, the circular waveguide, even though so dimensioned as to suppress all modes of signal B other than the TE01 mode, might in that case allow or support, at the TM01-mode transducer, the excitation in the circular waveguide of such spurious modes as the TE21 mode of signal B.

Figure 5A:
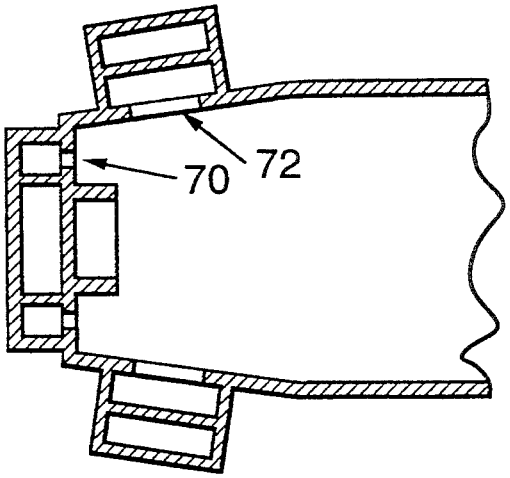
FIG. 5A is a cross-section corresponding to FIG. 5 of a portion of another joint structure, which shows two transducers together.

To prevent this spurious excitation of unwanted propagation modes when the frequencies are close together, the circular waveguide may be of tapered form, as illustrated in FIG. 5A. Of the two signals, the signal A with the (slightly) lower frequency is fed into the transducer 70, which excites that signal in the circular waveguide in the TM01 mode. The other signal B is fed to the transducer 72, which excites that signal in the TE01 mode.

Figures 2C, 2D:
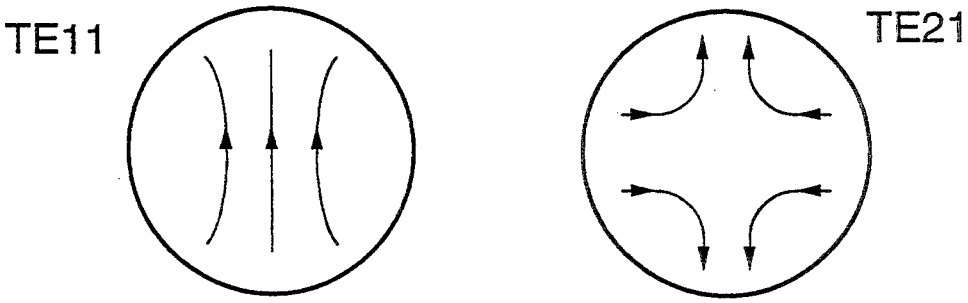
FIGS. 2C and 2D are diagrams illustrating electric field lines of undesired modes of microwave energy propagation in the circular waveguide of the rotary joint of FIG. 1.

The circular waveguide has to be large enough to carry the signal B in the TE01 mode. If the frequency of signal A is the same, or nearly the same, as the frequency of signal B, that size of waveguide is able to carry signal A not only in the TM01 mode, but in a number of other modes also, for example the TE11 (see FIG. 2C) or TE21 (FIG. 2D) modes, and precautions should therefore be taken in order to prevent these other modes being excited.

Thus, the diameter of the stub-waveguide of the TM01-mode transducer is made small, so that the other modes are not excited. The circular waveguide, at the transducer, only need be 0.76 wavelengths in diameter in order to support TM01.

Once the TM01 mode has been launched into the circular waveguide at the smaller diameter by the transducer 70, that mode can pass via the taper into the circular waveguide of large diameter, without other modes of that signal being excited. As mentioned, the tapered circular waveguide as shown in FIG. 5A is an option in case the frequencies are so close together that the designer, in dimensioning the waveguide at the TM01-mode transducer to support the TM01 mode as the dominant mode, might provide a waveguide that supports the TE21 mode.

In theory, to support the TE01 propagation mode, the circular waveguide should be 1.22 wavelengths in diameter. A waveguide large enough to support the TE01 mode will also support the TE21 mode, and therefore care must be taken also to suppress the TE21 mode at the TE01-mode transducer. If only two slots 40 were provided in the TE01-mode transducer, the TE21 mode then would be excited, or permitted: but the use of the four slots as shown ensures that only TE01 is launched.

Figure 6A:
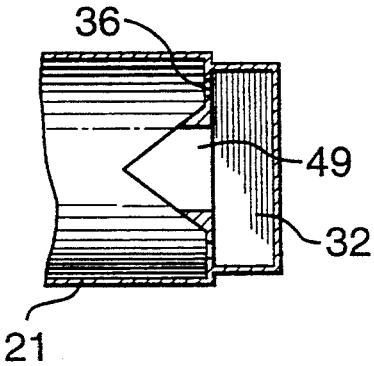
FIGS. 6A and 6B are cross-sections corresponding to a portion of FIG. 3, showing modified transducers.
Figure 6B:
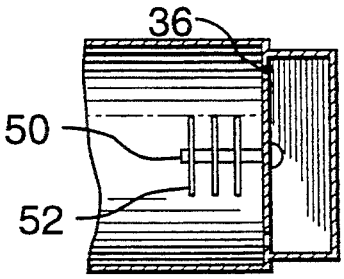

Some modifications to the means for exciting the TM01 mode in the circular waveguide are shown in FIGS. 6A and 6B. In these structures, the slots are supplemented by a cone 49 (FIG. 6A) and a post 50 carrying discs 52 (FIG. 6B). These features, like the annular ring 54 in FIG. 3, serve to improve the return-loss performance of the transducer.

Figure 7:
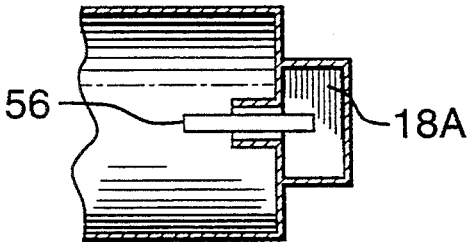
FIG. 7 is a cross-section corresponding to FIG. 6A of another modification of transducer.

The TM01 mode can also be excited in the circular waveguide by means of the structure of FIG. 7, wherein the excitation is produced by an isolated co-axial rod 56. Such a structure can excite only a circular magnetic field, and therefore other modes are not excited. No slots are required to excite the TM01 mode in the structure shown in FIG. 7.

Figure 8:
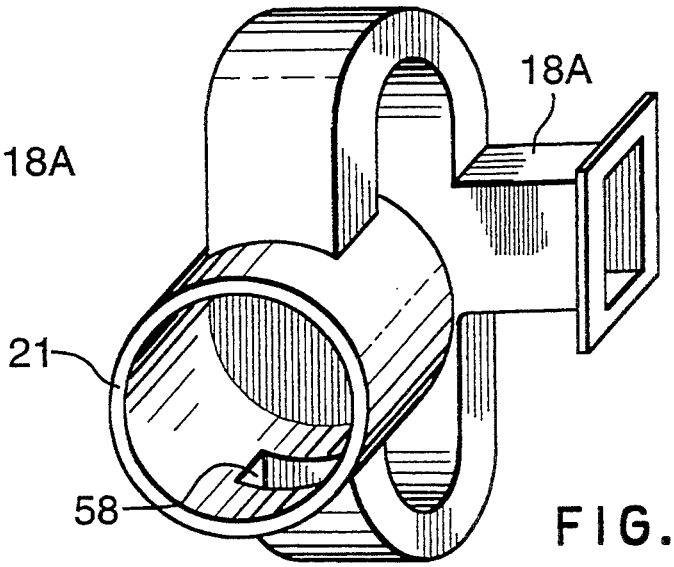
FIG. 8 is a pictorial view showing another modification of transducer.

FIG. 8 shows yet another structure; for exciting the TM01 mode in the circular waveguide. The slots 58 are two in number.

Proper launching of the TM01 and the TE01 propagation modes in the circular waveguides requires the use of effective reflectors at the transducers. The annular ring 54 (FIGS. 3 and 5) comprises a reflector which establishes a reflection plane, defined by the end-most protruding face of the ring, which is axially in-line with the four slots 40. The portion of the energy that passes the slots 40 is reflected at the reflection plane, whereby there is a substantially complete energy coupling between the circular waveguide, via the slots 40, to the rectangular wrap-around waveguide. The ring comprises an effective reflector for the TE01 mode (signal B). It is recognised that the ring 54 also facilitates the coupling of the TM01 mode of signal A, through the slots 36. By the use of the ring (or the devices shown in FIGS. 6A, 6B, and 7) as the reflecting means, such mode can be effectively launched. In this manner, the launching of one mode is achieved without penalty to the other mode.

As shown in FIG. 5, bearings 29 guide the rotor 14 with respect to the stator 16. At the interface between the two, recesses 60 produce a choke action, to prevent spurious energy modes being excited at or by the interface. Also as shown in FIG. 5, the joint structure is relatively inexpensive: to manufacture. Access is gained to the various internal surfaces and compartments for machining purposes by splitting the structure along the part-lines as illustrated. The separable components may be bolted together, or may be secured permanently, by brazing etc.

In the various drawing figures, the same numerals are used to refer to the same features. In FIGS. 3, 4A, 4B, and 8, numeral 21 again refers to the cylindrical stub. In FIG. 5, numerals 18A, 18B, 23A, 23B refer to the respective ports, numeral 27 is the axis, numeral 34 the end wall, numeral 40 the slot, numeral 43 the chamber, numeral 47 the outer chamber, and numeral 60 the recess. In FIGS. 5 and 6A, numeral 32 again is the H-plane Tee junction box chamber. In FIGS. 5 and 6B, numeral 36 refers to the slots. In FIGS. 5, 7, and 8, numeral 18A again is the port.

The numerals 12, 14, 16, 18A, 18B, 20, 21, 23A, 23B appear in FIG. 1.

The numerals 18A, 21, 32, 34, 36, 54 appear in FIG. 3.

The numerals 18B, 21, 40, 43, 45, 47 appear in FIG. 4A.

The numerals 18B, 21, 40, 43, 45, 47 appear in FIG. 4B.

The numerals 14, 16, 18A, 18B, 20, 21, 23A, 23B, 25, 27, 29, 32, 34, 36, 38, 40, 43, 47, 54, 60 appear in FIG. 5.

We claim:

1. Rotating joint for carrying two separate microwave signals, being a TM01-signal propagating in the TM01 mode, and a TE01-signal propagating in the TE01 mode, wherein;

the joint includes a stator member, a bearing, and a rotor member which is supported by the bearing and is guided thereby for rotation about an axis of rotation with respect to the stator member;

the rotor member and the stator member include respective stub-waveguides, each stub-waveguide being of circular cross-sectional form, having cylindrical walls defining a hollow interior, and an end-wall;

the stub-waveguides are disposed co-axially in-line on the said axis of rotation, and are of such dimensions and structure as to be able to propagate the TM01-signal, and simultaneously to propagate the TE01-signal;

the rotor member and the stator member each including a respective rectangular waveguide A and each including a respective rectangular waveguide B;

the rotor member and the stator member each including a respective TM01 transducer, for transducing energy in the respective rectangular waveguide A into the TM01 mode in the corresponding stub-waveguide, and each including a respective TE01 transducer, for transducing energy in the respective rectangular waveguide B into the TE01 mode in the corresponding stub-waveguide;

the joint includes an interface means which is so arranged as to simultaneously propagate energy in the TM01 mode and energy in the TE01 mode between the two stub-waveguides, through the interface means, substantially without the excitation of other modes at the joint;

and with respect to at least one of the rotor or stator members:

the end wall of the stub-waveguide associated therewith is so placed as to define a closed end to the cylindrical walls of the corresponding stub-waveguide;

the rectangular waveguide A associated therewith includes an H-plane Tee-junction box chamber;

the chamber of the associated rectangular waveguide A is disposed, with respect to the hollow interior of the corresponding stub-waveguide, outside the end wall thereof;

and the TM01 transducer associated therewith comprises slots disposed in the end wall thereof, the slots comprising an energy-propagating communication between the associated circular waveguide and the corresponding box chamber.

2. Joint of claim 1, wherein the interface means comprises recesses disposed in the walls of the associated circular waveguide at the interface, so arranged as to constitute a choke.

3. Joint of claim 1, in operational use and carrying microwave signal A in the TM01-mode and microwave signal B in the-TE01 mode simultaneously in the circular waveguide, wherein the two signals in the respective rectangular waveguides A and B are propagated both in the rectangular-TE01 propagation mode.

4. Joint of claim 1, in operational use and carrying microwave signal A at a frequency A in the TM01 mode, and microwave signal B at a frequency B in the TE01 mode, wherein frequency B is greater than, but not more than twice, frequency A.

5. Joint of claim 1, wherein the slots in the associated end wall are two in number.

6. Joint of claim 1, wherein the rectangular waveguide B of the said at least one member is in energy-propagating communication with an annular chamber, which is disposed in a wrap-around relationship with respect to the circular stub waveguide associated therewith;

and the TE01 transducer associated therewith includes axially-aligned slots disposed in the cylindrical wall of the corresponding stub-waveguide.

7. Joint of claim 6, wherein the axially aligned slots are four in number.

8. Joint of claim 7, wherein the rectangular waveguide B includes a portion thereof which is disposed in wrap-around relationship with the corresponding annular chamber;

and the TE01 transducer includes two slots in energy-propagating communication between the portion and the corresponding annular chamber.

9. Joint of claim 1, wherein:

the TM01 transducer associated therewith includes two slots disposed in the end wall thereof, the slots being in energy-propagating communication between the associated circular waveguide and the corresponding box chamber;

the rectangular waveguide B of the at least one member is in energy-propagating communication with an annular chamber, which is disposed in a wrap-around relationship with respect to the corresponding circular stub waveguide;

and the TE01 transducer associated therewith includes four axially-aligned slots formed in the cylindrical wall of the corresponding stub-waveguide.

10. Joint of claim 1, wherein the structure of the stator member is substantially identical to the structure of the rotor member.

11. Joint of claim 1, wherein, with respect to at least one of the stator or rotor members:

the TE01 transducer associated therewith includes four axially-directed slots, disposed in an equispaced relationship around the walls of the corresponding circular stub-waveguide;

the TE01 transducer includes two inner chambers, each of part-annular form, which are disposed in a wrap-around relationship with respect to the circular stub-waveguide, and which are located diametrically opposite each other with respect to the said axis of rotation;

the four slots are open between, and are in energy-propagating communication between, the inner chambers and the interior of the corresponding circular waveguide;

the annular extent of the two inner chambers is such that two adjacent slots of the said four slots open into one of the inner chambers, and the other two slots of the four open into the other inner chamber;

the TE01 transducer includes an outer part-annular chamber, which is disposed in a wrap-around relationship with respect to the two inner chambers;

the TE01 transducer includes a pair of axially-directed slots, and the two slots are open between, and are in energy-propagating communication between, the outer chamber and the two inner chambers respectively;

and the outer chamber is an E-plane junctional continuation of the rectangular waveguide B.

12. Combination of waveguides and transducers for the simultaneous propagation of microwave energy in TM01 and TE01 propagation modes in a circular waveguide, wherein:

the combination includes a circular waveguide and two rectangular waveguides A and B;

the circular waveguide comprises a cylinder, having an axis and having cylindrical walls defining a hollow circular-cylindrical interior, having a diameter, and an end-wall;

the combination includes a TM01-mode transducer, for transducing a microwave energy propagation mode in rectangular waveguide A into a circular-symmetrical TM01 propagation mode in the circular waveguide:

the combination includes a TE01-mode transducer, for transducing a microwave energy propagation mode in rectangular waveguide B into a circular-symmetrical TE01 propagation mode in the circular waveguide:

the TE01-mode transducer is located in the cylindrical walls of the circular waveguide, adjacent to the end wall;

the combination includes a reflector means, which is so located in relation to the end wall and to the TE01-mode transducer as to reflect energy propagating in the TE01 mode in the circular waveguide, away from the end wall;

the rectangular waveguide B has a main body, which terminates in an H-plane Tee-junction box chamber, being a chamber of hollow rectangular cross-section, having two long side-walls and two short side-walls;

the rectangular waveguide B has a longitudinal axis which intersects the axis of the circular waveguide at right angles thereto;

the cylinder and the box share a common wall, said common wall being the said end-wall of the cylinder, and being one of the long side-walls of the box;

the common wall is physically and electrically integral with the said cylindrical walls and with the said side-walls;

the TM01-mode transducer comprises slots disposed in the common wall, the slots providing energy-propagating communication between the cylinder and the box;

and the slots in the common wall are located symmetrically upon the diameter of the cylinder, and the slots extend laterally symmetrically from the said diameter, being a diameter of the cylinder which lies perpendicular to the axis of the rectangular waveguide.

13. Combination of claim 12, wherein, with respect to the TE01-mode transducer:

the TE01-mode transducer includes a wrap-around rectangular waveguide;

the wrap-around rectangular waveguide is in energy-propagating communication with an annular chamber, and with the rectangular waveguide B;

the annular chamber is disposed in a wrap-around relationship about the cylindrical walls of the circular waveguide;

the TE01-mode transducer includes four axially-aligned slots disposed in the cylindrical walls of the circular waveguide;

the wrap-around rectangular waveguide includes a portion thereof which is disposed in wrap-around relationship with the annular chamber;

and the TE01-mode transducer includes two slots in energy-propagating communication between the portion and the; annular chamber.

14. Combination of claim 13, wherein the reflector means defines a reflection plane;

and the reflector means is so disposed and arranged as to locate the reflection plane, being a plane in cross-section of the circular waveguide, in-line axially with the said four slots.

15. Combination of claim 14, wherein:

the reflector means comprises a reflection cylinder;

the reflection cylinder extends into the circular waveguide from the said common wall;

the reflection cylinder is disposed at a smaller radius than a radius at which the slots are located in the common wall;

and the reflection cylinder terminates at a plane which is in-line axially with the said four slots.

16. A TE01-mode transducer, for transducing microwave energy between a rectangular waveguide and a circular waveguide, the energy in the circular waveguide being propagated in the TE01 propagation mode;

the circular waveguide comprises a cylinder having an axis and having cylindrical walls defining a hollow interior;

the rectangular waveguide has a longitudinal axis which orthogonally intersects the axis of the circular waveguide;

the transducer includes four axially-directed slots, disposed in an equispaced relationship around the cylindrical walls of the circular waveguide;

the transducer includes two inner chambers, each chamber being of part-annular form, which are disposed in a wrap-around relationship with respect to the circular waveguide, and which are located diametrically opposite each other with respect to the axis of the circular waveguide;

the four slots are open between, and are in energy-propagating communication between, the inner chambers and the interior of the circular waveguide;

the annular extent of the two inner chambers is such that two adjacent slots of the said four slots open into one of the inner chambers, and the other two slots of the four open into the other inner chamber;

the transducer includes an outer part-annular chamber, which is disposed in a wrap-around relationship with respect to the two inner chambers;

the transducer includes a pair of axially-directed slots, and the two slots are open between, and are in energy-propagating communication between, the outer chamber and the two inner chambers respectively;

and the outer chamber is an E-plane junctional continuation of the rectangular waveguide.

17. Transducer of claim 16, wherein the two slots comprising the said pair of slots are diametrically opposite each other, with respect to the axis of the circular waveguide.

* * * * *